United States Patent [19]

Consler et al.

[11] Patent Number: 4,919,466

[45] Date of Patent: Apr. 24, 1990

[54] REUSABLE PACKAGE STRAP HANDLE

[75] Inventors: Donald Consler, Safety Harbor; Joseph B. Federico, Jupiter, both of Fla.

[73] Assignee: Paragon Patent Development Inc., Oldsmar, Fla.

[21] Appl. No.: 301,722

[22] Filed: Jan. 26, 1989

[51] Int. Cl.[5] ..... A45F 5/10

[52] U.S. Cl. ..... 294/170; 16/114 R

[58] Field of Search ..... 16/114 R, 114 B, 119, 16/124; 294/171, 170, 137, 153, 154, 156

[56] References Cited

U.S. PATENT DOCUMENTS

| | | | |
|---|---|---|---|
| 556,877 | 3/1896 | Beers | 294/170 |
| 606,936 | 7/1898 | Ottignon | 294/171 |
| 609,946 | 8/1898 | Pusey | 294/137 |
| 1,000,118 | 8/1911 | Pope | 294/170 |
| 3,400,870 | 9/1968 | DiVietri | 16/114 R |
| 4,696,505 | 9/1987 | Shadoah | 294/153 |

*Primary Examiner*—Nicholas P. Godici

*Assistant Examiner*—Carmine Cuda

*Attorney, Agent, or Firm*—Frijouf, Rust & Pyle

[57] ABSTRACT

There is disclosed a removable handle for use on twine or flat lashing. The handle has at least one portion extending toward the lashing, for gripping the lashing. The extended portion has a distal end with a relatively flat end surface with curving section. Attached to the distal end is a gripping surface having a "U" configuration where the base of the "U" is relatively flat and substantially equal in width to the distal end flat surface. One side of the "U" is relatively short and disposed in relationship to the curved section of the distal end so as to form a gap between the top of the short side and the curved section for the insertion of the lashing. The flat section of the distal end can contain a semi-circular notch through which twine will fit. In one embodiment, the handle has two extended portions each having a U-shaped gripping section on the distal end thereof. The short, or open sections of the two "U" gripping sections face in opposite directions with respect to the longitudinal axis of the lashing.

18 Claims, 2 Drawing Sheets

REUSABLE PACKAGE STRAP HANDLE

BACKGROUND OF THE INVENTION

1. Field of the Invention

This invention relates to handles, and more particularly to a reusable handle for use with package strapping material.

2. Description of Prior Art

Handles are on everything, from teacups to suitcases. In some cases, the handle protects our hands from extreme temperature. In other cases, the handle gives us the ability to pick up objects that otherwise would be difficult to grasp. Of course, as the object to be lifted becomes heavier, the importance of the handle increases.

Some objects, because of their physical size or because of their weight, are difficult to pick up and carry. Often, it is required to lash several objects together so that they can be carried as one bundle. Several traditional methods have been used for this, beginning with twine wrappings and extending through exotic straps of many different materials. Handles have been fashioned to slip over the twine to ease the burden of carrying heavy objects. These handles usually have circular eyes so that the twine, or rope, lashing will pass through the eyes of the handle making a secure structure. Typically, these handles become a permanent part of the lashing.

A mjor problem with these types of handles is that they are constructed from wire, with a loop at each end to engage the string, or rope, lashings. Not only are such handles not suited for use with straps, they are hard on hands and not sturdy enough for heavy or repeated usage.

Accordingly, a need exists in the art for a package handle which allows for easy insertion into existing lashing, regardless of the shape of the lashing, and which will not slip out of the lashing when the object is lifted or while the object is being carried.

A further need exists for a package handle which can be used for either rope or flat strapping and which is sturdy enough for use on many different packages and which is easily removable from a given package and which will not slip off a package while under load.

A further need exists for a package handle which can be used for either rope or flat strapping and which is easily moved from package to package, not easily released from a package while under load, and comfortable to grip even when used with heavy loads.

The foregoing has outlined some of the more pertinent objects of the present invention. These objects should be construed to be merely illustrative of some of the more pertinent features and applications of the invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

To solve the aforementioned problems, we have invented a removable handle which has an interlocking section disposed on either side of a grippable handle with flat sections arranged to slip onto a flat lashing or onto a round lashing and to remain locked with the lashing so long as there is pressure on the lashing. The handle has at least one portion extending toward the lashing, for gripping the lashing. The extended portion has a distal end with a relatively flat end surface with curving section. Attached to the distal end is a gripping surface having a "U" configuration where the base of the "U" is relatively flat and substantially equal in width to the distal end flat surface. One side of the "U" is relatively short and disposed in relationship to the curved section of the distal end so as to form a gap between the top of the short side and the curved section for the insertion of the lashing. The flat section of the distal end can contain a semi-circular notch through which twine will fit. In one embodiment, the handle has two extended portions each having a U-shaped gripping section on the distal end thereof. The short, or open sections of the two "U" gripping sections face in opposite directions with respect to the longitudinal axis of the lashing.

Thus, it is one feature of our invention to provide a handle which can grip either a twine lashing or a flat lashing and which once gripped to a lashing will remain locked thereto while load is on the lashing.

It is another feature of our invention to provide a removable handle for use with flat and round lashings such that the handle has a gripping section on one side having a forwardly opening slot and a gripping section on the opposite side having a rearwardly opening slot such that to remove the handle from the lashing an upward motion with respect to the handle must be used in combination with a twisting motion.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that each equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DISCUSSION

Figure 1:
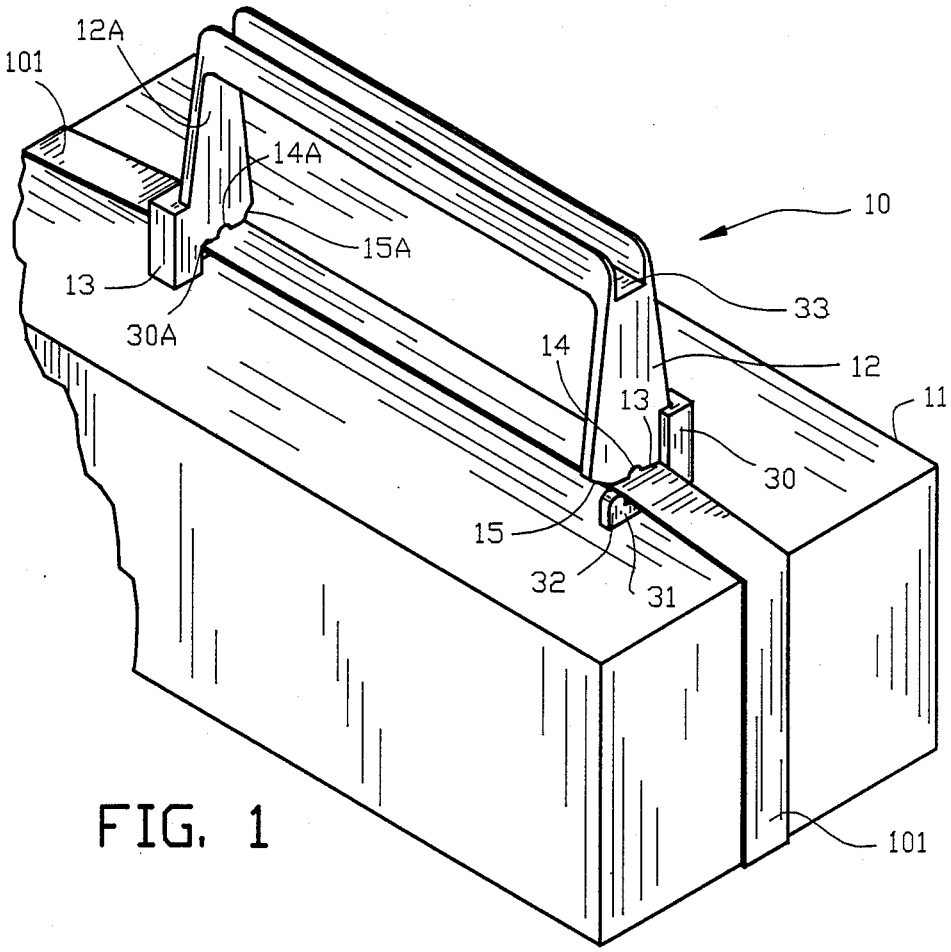
FIG. 1 shows an isometric view of a package having a handle for gripping a lashing.

FIG. 1 shows package 11 having lashing 101 wrapped there around. As will be seen, this lashing is shown as being flat in one embodiment but it could be string or rope lashing as well. Removable handle 10 is shown engaging lashing 101. Handle 10 has a hand grippable section 33 formed in the shape of a channel with its longitudinal axis extending in the same direction as the longitudinal axis of the lashing. The "U" channel of section 33 gives strength and rigidity to the handle while preserving its light weight. Either end of section 33 has side sections 12 and 12A which extend downward toward the lashing in a plane perpendicular to the longitudinal axis of grippable section 33. Side pieces 12 and 12A flare outward toward their distal ends. The amount of the flare is a design choice, but should be sufficient to allow the distal end to overhang the intended lashing. The distal end of each side piece 12, 12A has a flat section 13 and a curved section 15 and 15A. Curved section 15 curves upward toward grippable section 33 with the radius of curvature around and perpendicular to the longitudinal axis of grippable section 33. In the center of the distal end of side section 12 is a semi-circular notch 14 which will grip twine or string.

Extending outwardly from side section 12 is U-shaped member 30 which is integrally connected to side piece 12 along one side of the "U". Member 30 has a relatively flat bottom section 31 for engaging the lashing strap and a short upwardly extending section 32 disposed in conjunction with curved section 15. "U" section 30 is outwardly of section 12 and displaced below the distal end of section 12 such that flat surface 31 is positioned substantially at the same level as bottom section 13 to form a slot for the lashing. Surface 31 is substantially the same width as lashing 101, and, as will be seen, can have teeth for gripping the lashing. The lashing fits under section 13 and over section 31 to create a bump in the lashing thereby further gripping the lashing and preventing the lashing from sliding.

In operation, handle 10 is slid onto lashing 101 such that lashing 101 passes through an expandable slot created between curved section 15 and short upwardly extending "U" bracket section 32. The right side bracket 12 is disposed with the curved end in one direction (facing forward) while the left side bracket 12A is disposed wtih the curved end in the opposite direction (facing aft). Thus, when handle 10 is placed onto a lashing, it tends to lock the lashing, particularly if a lifting force is applied on the handle. Upwardly extending sections 32 and 32A prevent the lashing from slipping out of the distal end of side sections 12, 12A.

Figure 2:
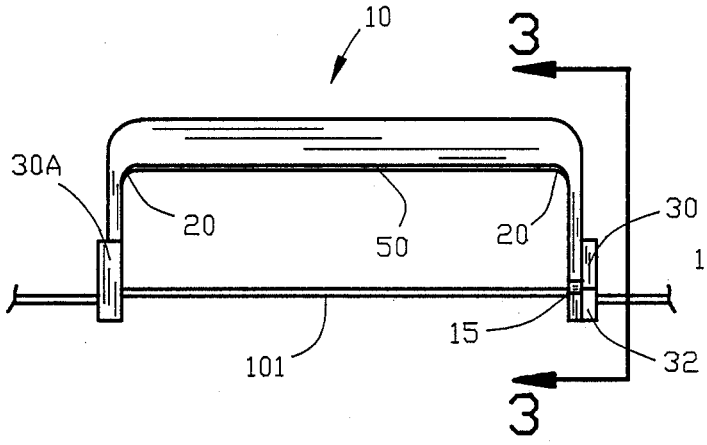
FIG. 2 is a front view of the handle.

FIG. 2 shows a side view of handle 10. It can be seen that channel 33 has a support rib 50 extending into supports 20 in the corners. This rib is to reduce flexing. It can be seen that right side "U" bracket 30 faces forward while left side "U" bracket 30A faces aft. These opposite facing slots are for added security against accidental release of the lashing. However, this is not mandatory and the handle will work properly if both slots opened in the same direction.

Figure 3:
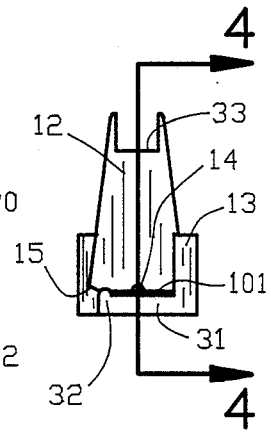
FIG. 3 is a side view of the handle.

FIG. 3 is a side view of the handle clearly showing semi-circular portion 14 in flat section 13 of the distal end of side section 12. Curved section 15 is seen behind "U" bracket section 32. The lashing, or twine, slips between section 15 and section 32. Ideally, section 32 almost touches section 15 so that pressure along the longitudinal axis must be exerted on section 32 to widen the slot between the sections for the insertion of the lashing. This also serves as a lock to maintain the lashing secured within the handle. The off-set construction allows for plastic material of the handle to bend outward thereby opening the slot. If the slot was constructed without the off-set, the force of the package pulling downward would widen the slot and the lashing could slip out.

Figure 4:
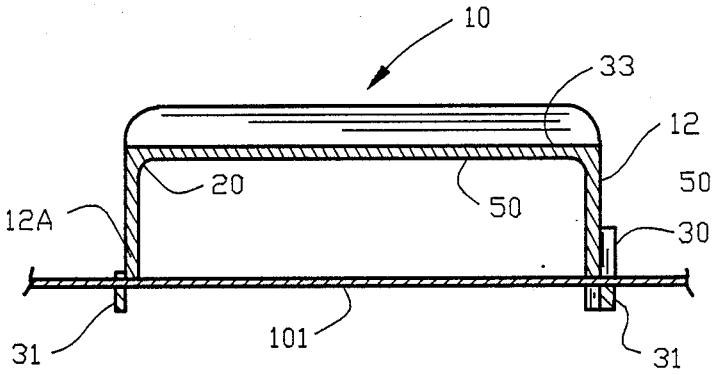
FIG. 4 is a front sectional view of the handle taken through section 4—4 of FIG. 3.
Figure 5:
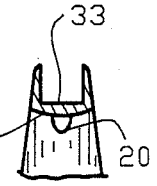
FIG. 5 is a side view of the sectional view of FIG. 4.

FIG. 4 is a sectional view taken through section 4—4 of FIG. 3 while FIG. 5 is a side view of the sectional view of FIG. 4 showing in better detail corner support 20.

Figure 6:
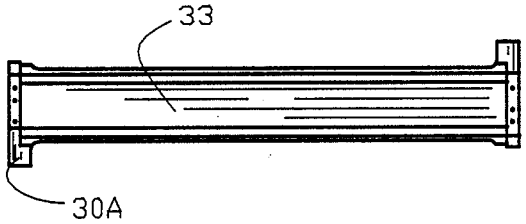
FIG. 6 is a top view.
Figure 6A:
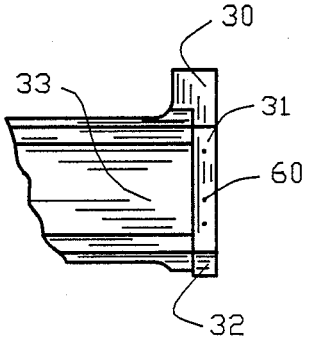
FIG. 6A is an enlarged partial view of FIG. 6.

FIGS. 6 and 6A are top views showing in better detail teeth 60 which can be positioned on bottom section 31 of "U" bracket 30. These teeth are used in one embodiment to engage the lashing when under pressure. The teeth can be any convenient size shape.

Figure 7:
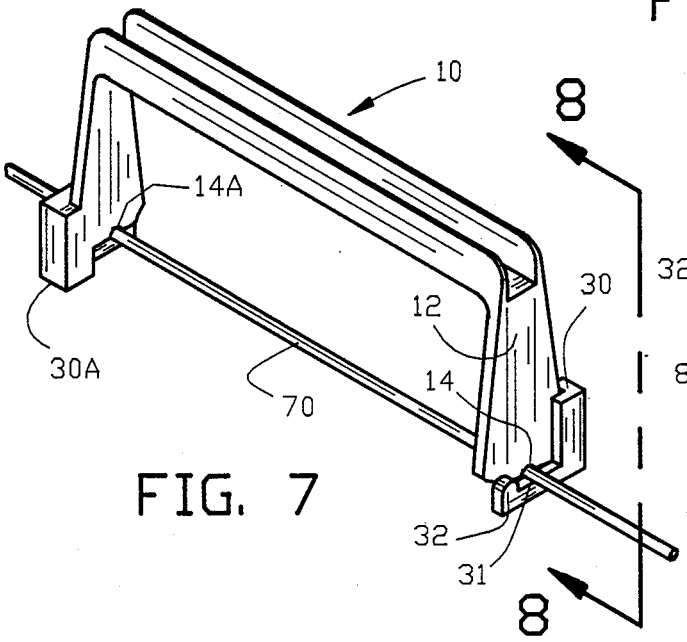
FIG. 7 is an isometric view of the handle gripping a round lashing.
Figure 8:
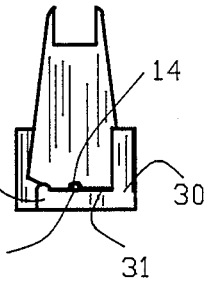
FIG. 8 is a section view taken through section 8—8 of FIG. 7.

FIG. 7 shows handle 10 engaging twine lashing 70 via semi-circular notches 14, 14A. FIG. 8 is a side sectional view taken through section 88 of FIG. 7 showing notch 14 in relationship with section 31 of "U" bracket 30. Also note that slot 80 is designed with very little, if any, gap, thereby requiring some downward force to widen the gap so that the lashing will fit therein. They also serve to lock the lashing in place.

The handle is designed for manufacture by injection molding, but other methods would certainly be possible.

The present disclosure includes that contained in the appended claims as well as that of the foregoing description. Although this invention has been described in its preferred form with a certain degree of particularity, it is understood that the present dislosure of the preferred form has been made only by way of example and that numerous changes in the details of construction and the combination and arrangement of parts may be resorted to without departing from the spirit and scope of the invention

What is claimed is:

1. A reusable handle for use on flat lashings, said handle comprising:

a hand grippable section having a finite length, the longitudinal axis of which extends in the same direction as the longitudinal axis of said lashing;

a pair of side sections dispersed on either end of said hand grippable section, said side sections each having a proximal end attached to one end of said hand grippable section and a distal end extended away from said hand grippable section in a plane perpendicular to the longitudinal axis of said hand grippable section;

each said distal end of said side sections including a relatively flat end surface with a curved section thereof;

U-shaped members where the base of each said "U" is relatively flat, and where one side of said "U" is relatively short, said short side being disposed in relationship to said curved section so as to form an expandable slot between the top of said short side and said curved section for the insertion of said lashing; and means, including said longer side of each of said U-shaped members, for connecting one of said U-shaped members to each of said distal ends of said side sections such that said flat base and said short side of each of said U-shaped member lie in a plane parallel to and offset from said plane of each of said distal end of said side sections, respectively.

2. The apparatus as set forth in claim 1 wherein said expandable slot widens by pressure applied to said U-shaped member along said longitudinal axis.

3. The apparatus as set forth in claim 1 wherein said curved section of one side section faces forward while the curved section of the other side section faces aft with respect to said longitudinal axis of said grippable section.

4. The apparatus as set forth in claim 1 wherein said connection means also includes means for maintaining said flat base of said U-shaped member outward and below said flat surface of said distal end to form an expandable slot therebetween.

5. The apparatus as set forth in claim 1 wherein said distal end flat surface has a semicircular notch in the center thereof.

6. The apparatus as set forth in claim 1 wherein said distal end of each said side section is wider than the width of said hand grippable section.

7. The apparatus as set forth in claim 1 wherein said offset of said flat base of said U-shaped member is such that the outer edge of said distal end of said sections is in substantially the same plane as the inner edge of said U-shaped member.

8. The apparatus as set forth in claim 1 wherein each said U-shaped member has a length approximately one-half said length of said hand grippable section.

9. The apparatus as set forth in claim 1 wherein said curved section has a radius of curvature around and perpendicular to said longitudinal axis of said hand grippable section.

10. The apparatus as set forth in claim 1 wherein said base of said U-shaped members are each at least as wide as the width of a lashing to be gripped.

11. The apparatus as set forth in claim 1 wherein said base of said U-shaped member has teeth thereon for gripping a lashing lying between said base and said flat surface of said side section.

12. An apparatus for gripping a lashing comprising:

a handle section, at least a portion of which extends toward said lashing, said handle section having a distal end for gripping said lashing;

said distal end of said handle section having a relatively flat end surface with a curved section thereof;

a second member having a "U" configuration where the base of the "U" is relatively flat, and where one side of said "U" is relatively short, said short side being disposed in relationship to said curved section of said handle section so as to form a gap between the top of said short side and said curved section for the insertion therebetween of said lashing; and wherein said member is connected to said handle section only along the side of the "U" opposite said short side such that said flat base and said short side of said second member lie in a plane parallel to and offset from the plane of said extended portion.

13. The apparatus as set forth in claim 12 wherein said gap is expandable by pressure applied to said second member perpendicular to the plane of said extended portion of said handle.

14. The apparatus a set forth in claim 12 wherein said distal end flat surface has a semicircular notch therein for accepting round lashings.

15. The apparatus as set forth in claim 12 wherein said second member is off-set from said handle section a distance such that the outer edge of said flat end surface of said handle sections is substantially in the same plane as the inner edge of said base of said second member.

16. The apparatus as set forth in claim 14 wherein said off-set is established to provide an expandable slot between the outer edge of said flat end surface and the inner edge of said second member base.

17. The apparatus as set forth in claim 12 wherein said base of said second member has teeth for gripping a lashing lying thereon.

18. The apparatus as set forth in claim 12 wherein said base of said second member is at least as wide as the width of a lashing to be held.

* * * * *